US005989387A

United States Patent [19]

Hyöty et al.

[11] Patent Number: 5,989,387

[45] **Date of Patent: *Nov. 23, 1999**

[54] METHOD FOR CONTROLLING CHLORIDE CONCENTRATION IN THE FLUE GAS OF A RECOVERY BOILER

[75] Inventors: Paavo Hyöty; Risto Hämäläinen; Maiju Alaniemi, all of Tampere; Keijo Imeläinen, Keminmaa; Pauli Harila, Kemi; Veli-Antti Kivilinna, Lautiosaari; Ahti Klami, Kemi, all of Finland

[73] Assignee: Tampella Power Oy, Tampere, Finland

[ * ] Notice: This patent issued on a continued prosecution application filed under 37 CFR 1.53(d), and is subject to the twenty year patent term provisions of 35 U.S.C. 154(a)(2).

This patent is subject to a terminal disclaimer.

[21] Appl. No.: 08/583,033

[22] PCT Filed: Jul. 12, 1994

[86] PCT No.: PCT/FI94/00322

§ 371 Date: Jan. 17, 1996

§ 102(e) Date: Jan. 17, 1996

[87] PCT Pub. No.: WO95/03449

PCT Pub. Date: Feb. 2, 1995

[30] Foreign Application Priority Data

Jul. 23, 1993 [FI] Finland ..... 933336

[51] Int. Cl.[6] ..... D21C 11/06

[52] U.S. Cl. ..... 162/15; 162/16; 162/31

[58] Field of Search ..... 162/14, 15, 16, 162/30.11, 31, 36

[56] References Cited

U.S. PATENT DOCUMENTS 3,396,076 8/1968 Crosby et al. ..... 162/33

FOREIGN PATENT DOCUMENTS 1064206 1/1979 Canada .
435302 9/1984 Sweden .

OTHER PUBLICATIONS

Warnqvist, Björn, et al.: "Chlorides in the Kraft . . . " International Bleaching Pulp Conference, May 2–6, 1976, (Chicago), pp. 13–18.

Warnqvist, B. et al., "Removal of Chloride From Recovery Systems by Reactions with Sulfur Dioxide" Svensk Papperstidning, No. 11, 1975, pp. 409–410.

*Primary Examiner*—Dean T. Nguyen
*Attorney, Agent, or Firm*—Ladas & Parry

[57] ABSTRACT

A method for adjusting the chlorine equilibrium in a sulphate cellulose process, wherein part of the chlorine contained in the cycle is separated and removed. In the method, strong odour gases from the sulphate cellulose process are introduced into a soda recovery boiler for burning so that chlorine contained in the liquor is in the form of hydrogen chloride (HCl) in the upper part of the soda recovery boiler and can subsequently be separated from the flue gases in a flue gas scrubber. The chlorine equilibrium is adjusted by removing part of the chlorine-containing washing solution.

12 Claims, 1 Drawing Sheet

METHOD FOR CONTROLLING CHLORIDE CONCENTRATION IN THE FLUE GAS OF A RECOVERY BOILER

The invention relates to a method for reducing the chlorine concentration in a sulphate cellulose process, wherein part of the chlorine content in the chemical cycle is separated from the cycle and removed.

BACKGROUND OF THE INVENTION

In the process of a sulphate cellulose mill, chlorine (essentially present in the combined form, primarily as sodium chloride) accumlates in the chemical cycle as the amount of chlorine accumlates the process from the raw material, such as wood, from water, together with substituting chemicals, etc., is greater than the amount of chlorine removed from the process in any form. Even though chlorine is removed together with the pulp and at other process stages, it, however, tends to accumlate in the process. Excessive chlorine causes disadvantageous corrosion and pluggings in the soda recovery boiler and is also otherwise disadvantageous in the regeneration of chemicals. Various attempts have been made to remove chlorine, e.g. together with salts in the form of NaCl. U.S. Pat. No. 3,746,612 discloses a method for removing chlorine from white liquor, where white liquor is treated in an extremely complicated way in order that chlorine contained in the solution could be separated as NaCl. In general, the removal of chlorine from the process is difficult in most cases and requires plenty of extra equipment. In addition, chlorine removal processes are difficult to adjust.

BRIEF SUMMARY OF THE INVENTION

The object of the present invention is to provide a method by means of which chlorine can be removed from the process easily and simply without any major equipment investments. The method according to the invention is characterized in that sulphurous odour gases are introduced into the soda recovery boiler at least in such an amount that the concentration of sulphur oxides in the soda recovery boiler is such that at least part of chlorine separating in gaseous form from the bed is in the form of hydrogen chloride in the upper part of the soda recovery boiler, that the hydrogen chloride is separated from the flue gases by scrubbing the flue gases, whereby the hydrogen chloride (HCl) contained in the flue gases reacts with a washing solution and can thus be removed by separating part of the washing solution of the flue gas scrubber.

An essential feature of the invention is that sulphorous strong and possibly diluted odour gases are introduced into the soda recovery boiler so that a sufficient proportion of chlorine separating from the boiler bed can be converted into hydrogen chloride in boiler conditions, whereby it can be separated from the flue gases by scrubbing with water or an alkali-water solution. Chlorine can thus be removed from the process efficiently while any remaining sulphur dioxide residues can be removed from the flue gases especially when alkali-water solution is used. At the same time the burning of odour gases produces more thermal energy, and the odour problems associated with the process are considerably smaller than previously. Another advantage of the invention is that odour gases can be eliminated by burning them in the soda recovery boiler so that they will not disturb the operation of the lime sludge reburning kiln or power boiler, and no separate odour gas burning apparatus or boiler need to be provided. In this way odour gases can be handled efficiently and economically.

The invention will be described more fully with reference to the attached drawings, in which

DETAILED DESCRIPTION OF THE INVENTION

Figure 1:
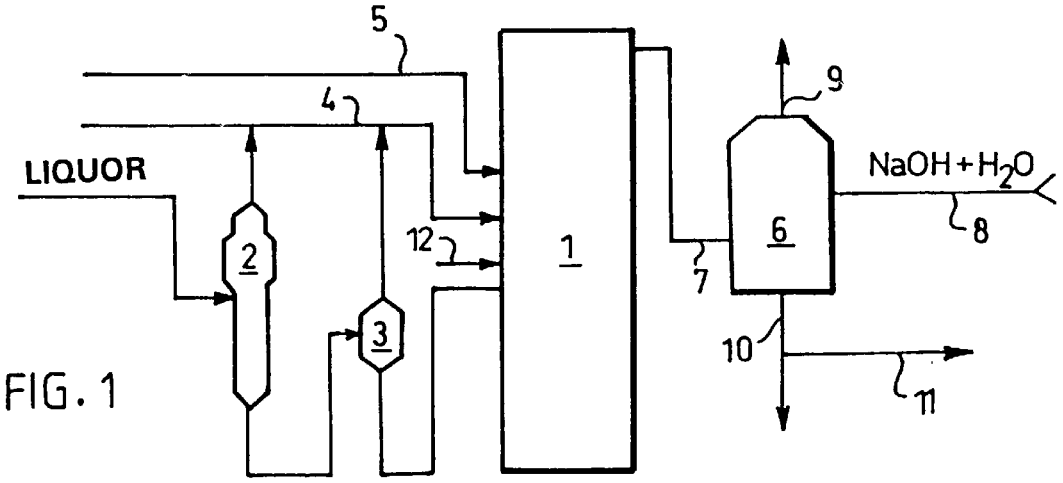
FIG. 1 illustrates schematically the application of the method according to the invention in connection with a conventional soda recovery boiler.

FIG. 1 shows a soda recovery boiler 1 into which black liquor is introduced for burning. The figure also shows a concentration unit 2 associated with an evaporation plant and intended for heating the liquor and delaying it for a predetermined period of time at an adequate temperature for separating sulphurous odour gases from the liquor. An expansion tank 3 is provided between the concentration unit 2 and the soda recovery boiler 1. Liquor from the concentration unit 2 is admitted to the expansion tank 3 for expansion so as to separate odour gases. The operating principle of the equipment is disclosed in U.S. Pat. No. 5,112,441 (corresponding to Finnish Published Specification 73 474), and therefore will not be described more fully herein. A duct 4 for strong odour gases from the expansion tank and the concentration unit and from other stages of the sulphate cellulose process and a duct 5 for diluted odour gases from other process stages are connected to the soda recovery boiler 1 so that odour gases can be burnt in the boiler. In this way the level of sulphur oxides in the flue gases of the recovery boiler is sufficient for keeping chlorine to be introduced into the soda recovery boiler along with the black liquor in a desired form. As used in the specification and claims of the present patent application, the term strong odour gases refers, among other things, to gases from the digester house and the evaporation plant, condensate stripping gases, and gases from the expansion tank of the concentration unit. These gases contain e.g. the following sulphurous compounds: $H_2S$, $CH_3HS$, $(CH_3)_2S$, $(CH_3)_2S_2$. The term diluted odour gases refers e.g. to gases from the washer room, tall oil cooking unit, vent gases from dissolver tanks and other tanks that contain small amounts of odorous sulphur, such as $H_2S$ or other odorous, mainly organic sulphur compounds. The figure further shows a flue gas scrubber 6, into which flue gases from the soda recovery boiler are passed through a duct 7. As used in the present patent application and claims, the term flue gases refers to gases contained in the soda recovery boiler which are further passed into a flue gas duct and further onwards. Water or preferably alkali-water solution is introduced into the flue gas scrubber through a feed conduit 8, whereby the scrubbed flue gases are discharged through a flue gas duct 9, and the washing solution is removed from the flue gas scrubber 6 through a discharge conduit 10. From the discharge conduit 10 a desired proportion of the washing solution is separated from the chemical cycle through a conduit 11 to adjust the chlorine equilibrium, and the rest is recycled into the process in a manner known per se. The figure further shows a conduit 12, through which sodium hydroxide, sodium carbonate compounds, such as sodium bicarbonate, or soap, can be introduced into the soda recovery boiler to increase the level of sodium in the boiler.

The sodium, sulphur and chlorine compounds of the soda recovery boiler and their formation are proportional to the surface temperature of the bed of the soda recovery boiler in the lower part of the boiler. Chlorine separates from the bed mainly as gaseous sodium chloride. If the black liquor to be introduced into the soda recovery boiler contains chlorine, nearly all of the sodium vaporized from the bed at low temperatures is in the form of chloride. In the bed, chloride is in a molten state, and chlorine (in the form of NaCl) is distributed between the bed and the reducing flue gas according to the temperature so that the level of gaseous sodium chloride increases with increasing temperature. Gaseous NaCl reacts in the upper part of the boiler with sulphur oxygen gas and water, thus forming solid sodium sulphate, which separates from the flue gases in connection with the separation of fly ash. Chlorine freed in this reaction forms hydrogen chloride (HCl).

$$2NaCl+SO_2+H_2O\tfrac{1}{2}O_2 \rightarrow Na_2SO_4+2HCl$$

In certain temperature conditions this reaction is nearly complete if the flue gases of the boiler contain sulphur oxides in a sufficient amount. If the sulphur content is too low, part of the sodium is not able to react, and so chlorine and sodium occur in the fly ash as sodium chloride.

Hydrogen chloride in turn reacts in the scrubber with sodium hydroxide, which gives sodium chloride and water, whereby chlorine can be removed from the process simply by removing only part of the washing solution.

$$HCl+NaOH \rightarrow NaCl+H_2O$$

Figure 2:
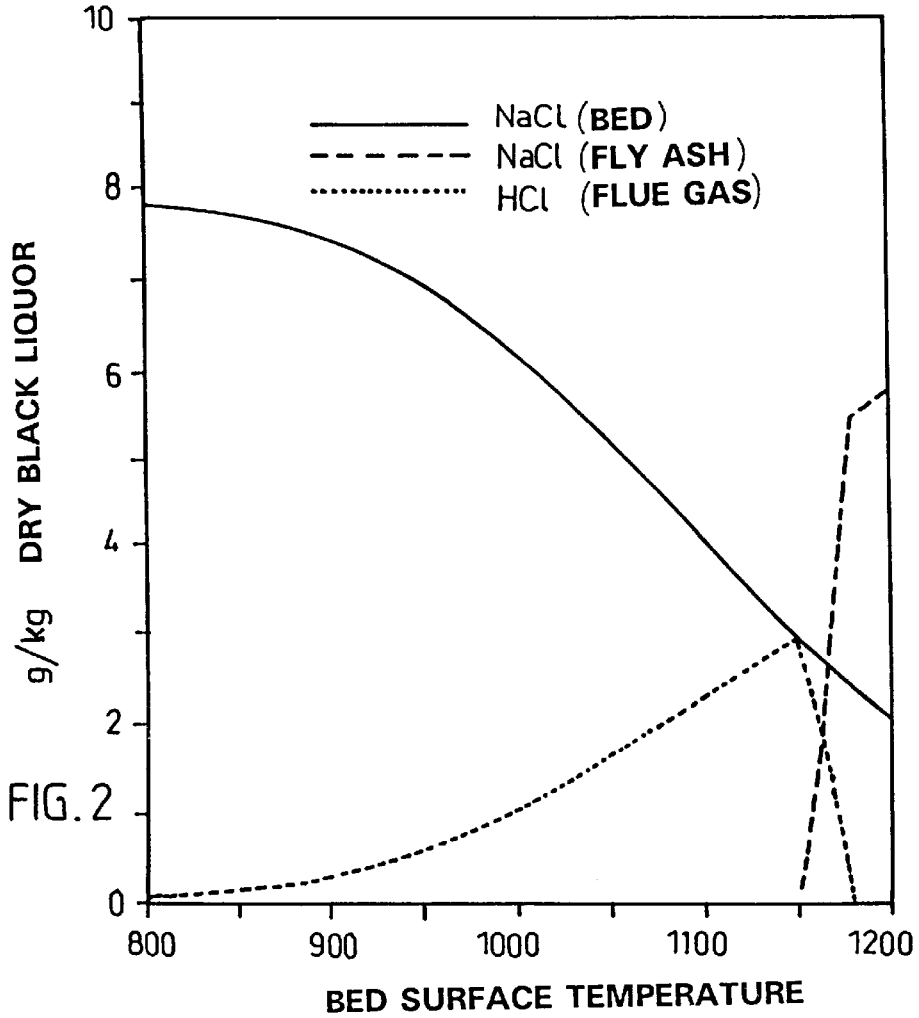
FIG. 2 shows an equilibrium diagram for the flue gases of a soda recovery boiler obtained from a practical embodiment.

FIG. 2 shows a diagram describing the equilibrium of flue gases in a soda recovery boiler. The curves of the diagram have been obtained by measuring in a practical embodiment. It appears from the figure how the amounts of gaseous components depend on the surface temperature of the bed of the soda recovery boiler when the ratio between sulphur and sodium in the black liquor is about 0.45. As also appears from the figure, chlorine is mainly in the form of chlorine-like hydrogen chloride (HCl) in the upper part of the soda recovery boiler when the temperature of the bed of the boiler is about 1,150° C. Sodium chloride contained in the bed decreases in a corresponding amount as the temperature increases to about 1,150° C., whereby there are not yet any substantial amount of solid sodium chloride entrained in fly ash. If the temperature rises above 1,150° C. in normal conditions, the HCl concentration drops abruptly, and sodium chloride is removed from the soda recovery boiler along with the flue gases, which manifests itself as an abrupt increase in the level of sodium chloride in the fly ash.

In order that chlorine could be maintained as extensively as possible as hydrogen chloride, which is easy to wash in the flue gas scrubber, the level of sulphur in the flue gases contained in the soda recovery boiler has to be high enough in order that the reaction conditions could be maintained advantageous in this respect. Normally, this is not the case, but the amount of sulphur in the flue gases is too small, and, as a result, the amount of sulphur oxides is too small, and so sodium chloride tends to remain in dust form in the flue gases. At high temperatures in particular the amount of sulphur normally contained in flue gases is not able to convert sodium chloride into sodium sulphate, as a result of which chlorine will not separate as HCl.

Excessive amounts of chlorine also enter the soda recovery boiler when biosludge formed in the water treatment stage of the sulphate cellulose process is introduced into the soda recovery boiler to be burnt with black liquor. Biosludge also typically contains chlorine in different forms, and when it is introduced into the soda recovery boiler, the level of chlorine in the boiler increases, which usually increases the amount of chlorine in the chemical cycle. In the invention, chlorine entering the process along with biosludge can also be taken into account and removed from the chemical cycle, if necessary.

In the present invention the amount of sulphur in the soda recovery boiler and thus the amount of sulphur oxides is increased by introducing sulphurous odour gases, especially strong odour gases, into the soda recovery boiler 1. Both diluted and strong odour gases may be introduced into the boiler, where sulphur burns into sulphur oxides and, if desired, even substantially all chlorine removed with the flue gases is in the form of hydrogen chloride. If any extra entrainment of sulphur oxides in the flue gases to the flue gas scrubber is to be avoided, odour gases are introduced into the soda recovery boiler for burning only to such an extent as is necessary for maintaining the chlorine as hydrogen chloride. A small amount of sulphur oxides thereby enters the flue gas scrubber, which can be scrubbed off by the use of an alkali-water solution.

As burning part of the odour gases in the soda recovery boiler would make it necessary to burn the rest of the odour gases separately either in the lime kiln or in some other combustion plant, the most advantageous way according to the invention is to introduce all odour gases into the soda recovery boiler so that their thermal energy can be recovered. When all odour gases are burnt in the soda recovery boiler, the amount of sulphur to be introduced or the conditions in the soda recover boiler may be adjusted in various ways, whereby the efficiency of the process will be maximized and a required amount of chlorine can be removed as HCl while sulphur is bound as solid sodium sulphate. This can be realized in various ways of adjustment, of which one prior art method is to adjust the S/Na ratio in the flue gases by varying the temperature of the bed of the soda recovery boiler. Furthermore, the amount of odour gases to be introduced and thus the amount of sulphur may be adjusted by heat treatment of liquor by varying the delay and temperature of the heat treatment. Moreover, sodium may be introduced into the soda recovery boiler as a compound that reacts in the boiler so that sodium and sulphur form sodium sulphate in accordance with the formula presented above. The obtained sodium sulphate can then be recycled into the chemical cycle, if required.

Sodium can be introduced into the soda recovery boiler in various ways, whereby it is possible to use different Na-containing materials, such as sodium hydroxide, sodium carbonate compounds or soap separated from black liquor before its introduction into the soda recovery boiler. Separation of soap in the evaporation plant before further concentration is necessary in order that the heat surfaces would not get dirty. Separation of soap from black liquor in connection with its evaporation is a prior art technique, which therefore will not be described in detail herein. When soap is introduced into the soda recovery boiler so that it passes by the heat surfaces of the rest of the evaporation plant, its thermal energy can be utilized while the sodium contained in it balances the S/Na ratio in the flue gases of the boiler. The chlorine equilibrium of the process can thus be adjusted in a desired way by removing chlorine by removing part of the washing solution from the cycle.

The invention has been described above and shown in the drawings only by way of example, and it is limited in no way to the example. Essential is that sulphureous odour gases, especially strong odour gases, are introduced into the soda recovery boiler at least in such an amount that chlorine in the upper part of the recovery boiler is in the form of HCl to a desired extent. In this way, it can be easily scrubbed off the flue gases, and no significant amounts of sodium chloride occur in the fly ash.

We claim:

1. A method for reducing the chlorine concentration accumulating in a sulphate cellulose process, which comprises the steps of:

a. feeding black liquor generated in the sulphate cellulose process to a soda recovery boiler for combustion and generation of flue gases;

b. introducing sulphurous odor gases generated in the sulphate cellulose process into the soda recovery boiler for burning in the boiler to generate further flue gases including sulphur oxides;

c. maintaining the feed rate of the sulphurous odor gases into the boiler in such an amount that the concentration of sulphur oxides in the recovery boiler is such that at least part of the sodium chloride content of the black liquor fed to the recovery boiler and vaporized in gaseous form from a bed in the lower portion of the recovery boiler is converted from sodium chloride by reaction with the sulphur oxides so as to produce hydrogen chloride present in the flue gases in the upper part of the recovery boiler;

d. removing said flue gases from the upper part of the recovery boiler to a scrubber;

e. removing hydrogen chloride by scrubbing said flue gases with a washing liquid in said scrubber; and f. separating at least a portion of said washing liquid.

2. A method according to claim 1, wherein the sulphurous odor gases originate from different stages of the sulphate cellulose process.

3. A method according to claim 2, wherein the sulphurous odor gases include all strong odor gases generated in the sulphate cellulose process.

4. A method according to claim 3, wherein all the sulphurous odor gases are introduced into the soda recovery boiler for burning.

5. A method according to claim 1, wherein the black liquour is heat-treated prior to introducing the black liquour into the soda recovery boiler for separating sulphur from the black liquour in gaseous form, and the sulphurous odor gases separated from the black liquour are introduced into the soda recovery boiler.

6. A Method according to claim 1, wherein a sodium compound is introduced into the soda recovery boiler for removing sulphur from the soda recovery boiler in the form of solid sodium sulphate entrained in flue gases.

7. A Method according to claim 6, wherein at least a portion of the sodium compound introduced is sodium hydroxide.

8. A Method according to claim 6, wherein at least a portion of the sodium compound introduced is a sodium carbonate compound.

9. A Method according to claim 6, wherein at least a portion of the sodium compound introduced is soap separated from black liquor.

10. A Method according to claim 1, wherein the surface temperature of the bed of the soda recovery boiler is between 900 and 1,250° C.

11. Method according to claim 10, wherein the surface temperature of the bed is between 1,100 and 1,200° C.

12. A method according to claim 1, which includes:

g. recycling said portion of the washing liquid to the sulphate cellulose process.

* * * * *